United States Patent [19]

Babunovic

[11] 4,061,152

[45] Dec. 6, 1977

[54] CONTAINER WASHING APPARATUS

[75] Inventor: Momir Babunovic, Des Peres, Mo.

[73] Assignee: Barry-Wehmiller Company, St. Louis, Mo.

[21] Appl. No.: 748,840

[22] Filed: Dec. 10, 1976

Related U.S. Application Data

[63] Continuation of Ser. No. 605,279, Aug. 18, 1975, abandoned.

[51] Int. Cl.[2] ..... B08B 3/02; B08B 9/08

[52] U.S. Cl. ..... 134/73; 134/104; 134/152; 134/169 R

[58] Field of Search ..... 134/73, 74, 83, 104, 134/111, 130, 152, 169 R

[56] References Cited

U.S. PATENT DOCUMENTS

| | | | |
|---|---|---|---|
| 2,710,818 | 6/1955 | Winters | 134/74 X |
| 3,162,204 | 12/1964 | Babunovic et al. | 134/74 |
| 3,868,960 | 3/1975 | Cove | 134/73 |

FOREIGN PATENT DOCUMENTS

| | | | |
|---|---|---|---|
| 996,123 | 12/1951 | France | 134/73 |

*Primary Examiner*—Robert L. Bleutge
*Attorney, Agent, or Firm*—Gravely, Lieder & Woodruff

[57] ABSTRACT

Apparatus for forceably flushing labels from containers being conveyed in pockets through a container washing machine, and a system of fluid flow in the apparatus for extracting the flushed out labels from the washing solution so the latter solution may be recirculated to repeat the flushing cycle. The fluid flow system is arranged to operate in a manner that will conserve energy without impairing the effectiveness of the flushing action.

11 Claims, 16 Drawing Figures

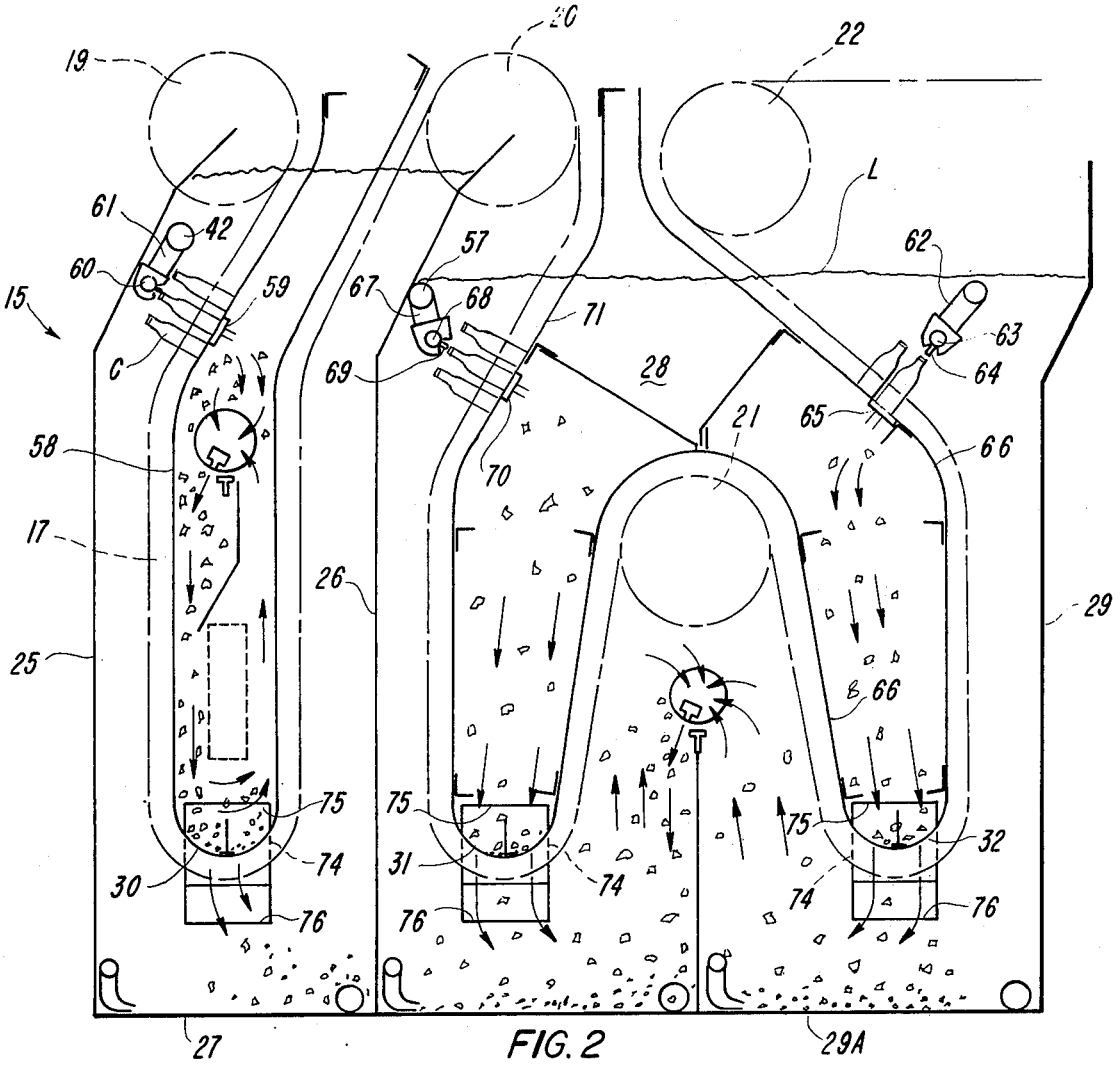
FIG. 2
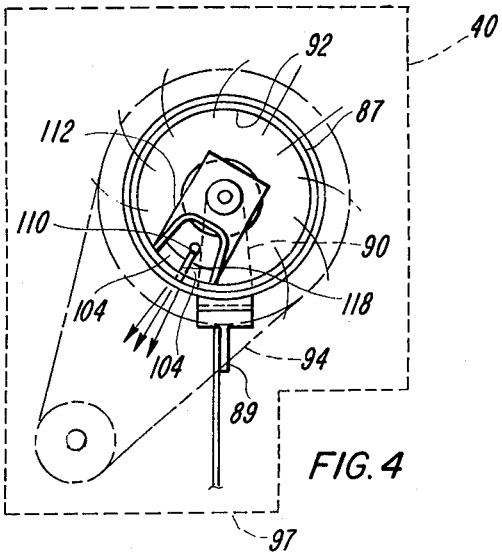
FIG. 4
FIG. 5
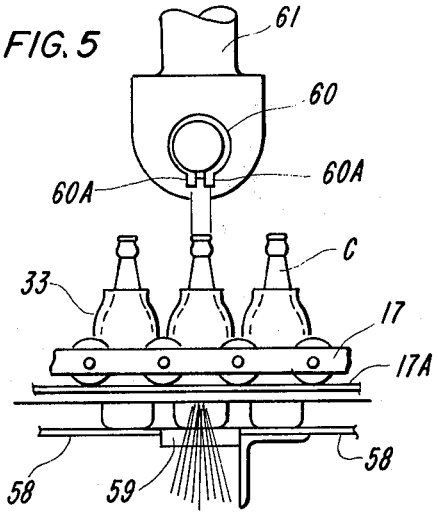

CONTAINER WASHING APPARATUS

This is a continuation of application Ser. No. 605,279, filed Aug. 18, 1975, now abandoned.

BACKGROUND OF THE INVENTION

This invention relates to container washing apparatus and is particularly directed to a system for filtering labels out of the washing fluid so the fluid may be reused, and to removing the labels as they collect.

Apparatus for washing containers used in the soft drink, beer and beverage business is continually faced with the problem of removing the labels from the external surface of the containers, and the large capacity apparatus handles a tremendous quantity of containers so the label accumulation problem is acute. Since the containers must be carried through the washing apparatus in pockets, difficulty is usually encountered in removing the labels from the pockets. If the labels are not removed from the pockets there is the possibility that a certain percentage of the containers will have the labels reapplied before being discharged. Washing apparatus utilizes caustic washing solutions in order to penetrate the adhesives, as well as the label material for the purpose of detaching the labels as quickly as possible. The caustic solution is generally heated so that it will more quickly penetrate and loosen the adhesives, whereby the labels can be flushed out of the pockets as the containers are moved into and out of the washing solution. There still remains the difficulty of the soaking time which contributes to getting the labels off the bottles and out of the carrier pockets, and for this reason washing apparatus is usually made with multiple compartments which consumes a large floor area. Large apparatus is expensive to operate and frequently has to be shut down in order to remove the accumulation of labels.

The present invention is directed to means of improving the operation and efficiency of washing apparatus, and is directed to positively flushing the labels from the carrier pockets at the time and place in the compartments when the hot caustic solution has effectively penetrated and loosen the adhesives. The hot caustic solution is delivered by suitable jets into the carrier pockets and over the containers therein so as to flush the labels out of the pockets. The flushing action is directed into a compartment which contains a rotating filtering screen mounted over a fluid inlet to a suction system for drawing the solution through the screen and thereby causing the labels to be strained out of the solution. The solution which has been freed of labels is recirculated back to the nozzles. The rotating screen is provided with an internal screen flushing manifold which is supplied with cleaned caustic solution, and the manifold delivers the solution outwardly through the screen to continually flush the labels off of the surface of the screen so as to avoid clogging the screen. The labels flushed off of the screen in this manner migrate to the bottom of the compartment where the accumulation can be continually removed by label removing apparatus of the character shown in my prior U.S. Pat. No. 3,162,204, granted Dec. 22, 1964. Accordingly the compartment is continually cleared of labels as they are flushed from the rotating screen and allowed to migrate toward the bottom of the compartment.

The objectives of the present invention are to provide container label flushing filtering apparatus which may be incorporated in container washing apparatus at one or more compartments, to provide a filtering screen and flow system that will continually flush labels from the containers and carrier pockets and generally confine the labels to an area for efficient removal, and to provide a flushing system which will conserve energy by intermittent operation of the flushing jets so as to reduce the pump capacity, and to continually filter labels from the flushing solution so that the pump will not be clogged with labels.

BRIEF DESCRIPTION OF THE DRAWINGS

The apparatus of this invention is shown in certain presently preferred embodiments in the accompanying drawings, wherein:

FIG. 2 is an elevational view of the washer seen in FIG. 1 but with the near side wall removed to show the internal components in full line;

FIG. 4 is a fragmentary sectional detail of the components seen in FIG. 3, the view being taken along line 4—4 thereof;

FIG. 5 is an enlarged and fragmentary view of the container flushing means seen in FIG. 3 at line 5—5;

DETAILED DESCRIPTION OF THE DISCLOSED EMBODIMENTS

Figure 1:
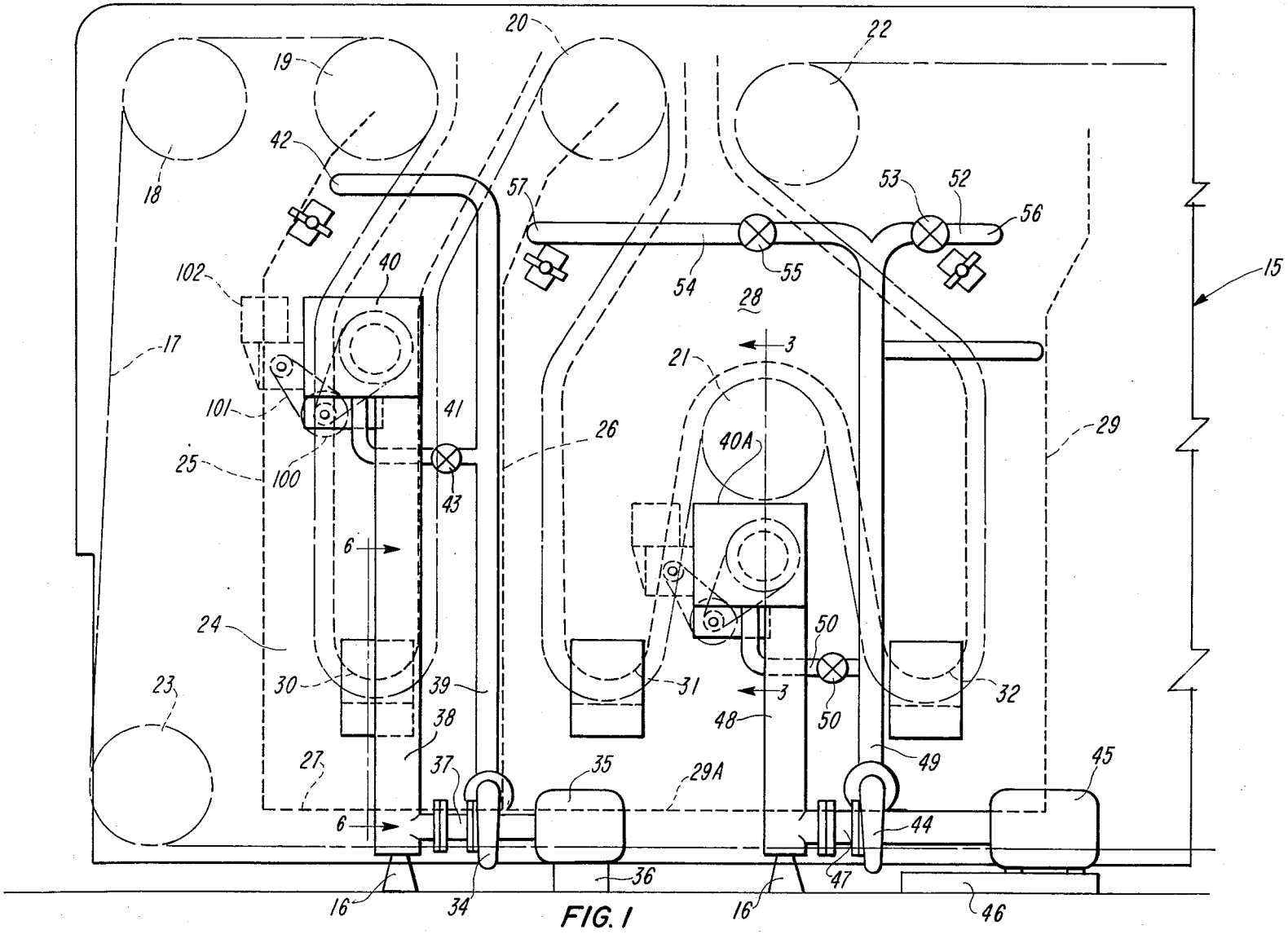
FIG. 1 is a side elevational view of so much of a container washing machine as will present the components of this invention normally assembled on the outside of the washer compartments.
Figure 6:
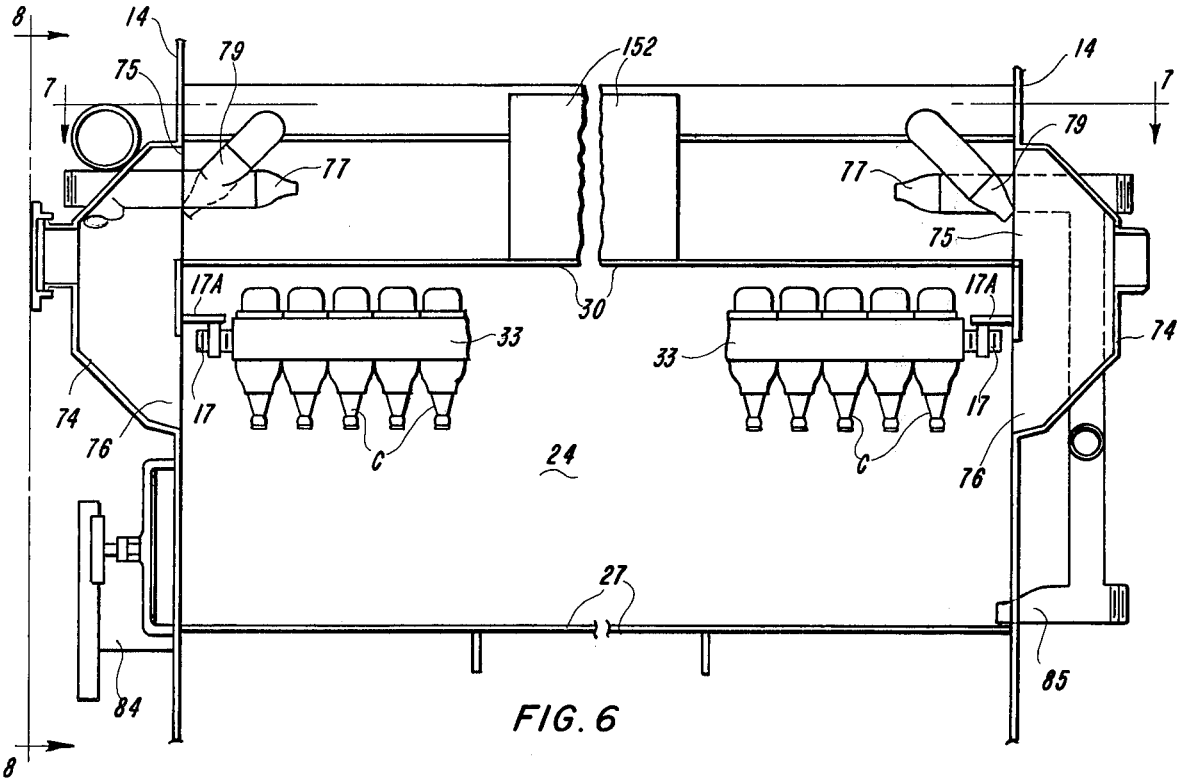
FIG. 6 is an enlarged and fragmentary view of the label collecting and moving means, the view being taken along line 6—6 in FIG. 1.

In FIG. 1 there is shown at 15 a fragmentary side elevational view of a container washing apparatus which is supported on a floor area by a sub-structure represented at 16. The apparatus encloses a roller chain conveyor represented by the phantom line 17, and this roller chain is trained over a series of sprockets 18, 19, 20, 21 and 22 on its bottle conveying circuit, and is returned at the lower left corner around sprocket 23. The interior of the apparatus is divided into a number of compartments, and for the purpose of this disclosure it is believed sufficient to show a compartment 24 defined between vertical partition walls 25 and 26 and a bottom wall 27. Compartment 24 is located adjacent a larger compartment 28 which is defined by the partition wall 26 of the adjacent compartment 24, a partition wall 29 and a bottom wall 29A. The roller chain moves over the sprocket 19 and descends into compartment 24 where it moves or loops around a bottom guide trough 30 and then travels upwardly around the upper sprocket 20 before again descending into compartment 28 where it turns or loops around a guide trough 31, travels upwardly over sprocket 21 before descending to move around a guide trough 32, and then travels upwardly around the upper sprocket 22. It is understood that there are a pair of roller chains 17 mounted on rails 17A at the opposite side walls of the apparatus, and the carriers for the containers are suspended between the roller chains 17. FIG. 6 illustrates a fragmentary portion of roller chains 17 and a typical container carrier 33 supporting containers C. This disclosure will of course be illustrative of the numerous container carriers 33 that will be attached to the roller chains 17 so that a continuous flow of containers will be carried through the compartments between the inlet mechanism and the discharge mechanism which have not been shown.

Still referring to FIG. 1 there is shown the arrangement of components which are organized on the outside of the wall 14 of the apparatus. Accordingly it is noted that there is a washing solution circulating pump 34 carried on the frame of a driving motor 35, and these two components are mounted on a pad 36 in a position such that the suction inlet 37 of the pump 34 is connected to the vertical suction conduit 38, and the pump discharge side is connected to a delivery pipe 39. The suction conduit 38 is connected into the bottom of a junction box 40 fixed on the side wall 14 so as to be in alignment with the compartment 24 between partition walls 25 and 26. The discharge pipe 39 from the pump 34 is connected into a branch pipe 41, while the main portion of the pipe 39 continues on above the junction box 40 and enters the wall 14 at the elbow 42. The branch pipe 41 contains a control valve 43 and the pipe 41 continues upwardly into the junction box 40 for a purpose presently to be described.

A second pump 44 is driven by a motor 45 and these two components are mounted on a pad 46 such that the pump suction 47 may be connected to a vertical conduit 48 which connects into a junction box 40A. The delivery side of the pump 44 is connected to a pipe 49 which rises vertically past a branch pipe 50 under control of a valve 51 and is divided at the upper end into a right hand branch 52 under the control of a valve 53, and a left hand branch 54 under the control of a valve 55. The branch 52 passes through the wall 14 at elbow 56 and the branch 54 enters the wall 14 at the elbow 57. It will be observed that the lower branch pipe 50 is directed into the junction box 40A for a purpose to be described presently.

FIG. 2 discloses the principal components in the apparatus 15, and the view is similar to FIG. 1 but with the exterior wall 14 and the external components removed so as not to complicate the disclosure. It is observed that the roller chains 17 is caused to follow a path determined by a fixed guide sheet 58 which has a descending portion connected into the bottom guide 30 and a rising portion which forms a U-shaped path for the roller chains 17. The guide sheet 58 is interrupted cross-wise of the apparatus by a series of spaced bars 59 at one limited location below the upper sprocket 19. The containers C are caused to move across the bars 59 and in crossing the bars the containers are bathed in a stream of solution from a series of nozzles carried in a manifold 60. The manifold is provided with a feed pipe 61 which is connected to the elbow 42 shown in FIG. 1 and asssociated with the pump delivery pipe 39.

The view of FIG. 5 is an enlargement of the arrangement of interrupting the guide sheet with a series of spaced bars 59, whereby the fluid jet stream issuing from nozzles 60A in the manifold 60 will direct the flow of the fluid over containers C and through the pockets of the carrier 33. This view also illustrates the roller chains 17 which is guided by the fixed rail 17A. It should now be clear that the jet stream issuing from the nozzles 60A bathes the container C and is directed into the pockets of the carrier 33 and passes through the space between the bars 59, carrying off the loosened labels in the process.

With further reference to FIGS. 1 and 2 it will be understood that the vertically directed pump delivery pipe 49 will deliver fluid to the branch pipe 52 and through the connection of elbow 56 (FIG. 2) will feed the pipe 62; Pipe 62 is connected to the manifold 63 to supply fluid to a series of nozzles 64 which will direct the fluid over containers C moving past the series of bars 65 which interrupt the guide sheet 66 in the right hand loop of the conveyor travel between sprocket 21 and sprocket 22. The left hand branch 54 of the vertical pump delivery pipe 49 is connected with elbow 57 which delivers the fluid to feed pipe 67 and the manifold 68 for delivering fluid to nozzles 69 for flushing the containers C which are moved over the bars 70 which interrupt the guide sheet 71 in the left hand loop of the conveyor between the sprockets 20 and 21. The guide sheet 71 is formed into a bottom loop trough 31 and the cooperating guide sheet 66 is formed into a bottom loop or trough 32. The troughs 31 and 32 are similar to the previously described trough 30, and each of the troughs functions to collect the labels which are flushed off the containers and out of the carrier pockets. It is, therefore, necessary to continuously remove the collection of labels from each of the respective troughs and such means for the trough 30 is seen in FIG. 6. The description of this means will of course be the same as for the means associated with the troughts 72 and 73.

In FIG. 6 the compartment 24 is closed at the bottom by wall 27 and by the opposite side walls 14. The trough is shown at 30 to extend between the side walls 14 such that the opposite ends are in connection with transfer ducts 74 positioned on the exterior of the walls 14. The ducts 74 have inlet ends 75 connecting with the trough 30 and outlet ends 76 connecting with the space below the trough 30 and above the compartment floor 27 so that there will be a way for the labels and the washing solution to pass from the trough 30 into the bottom of the compartment 24.

Figure 7:
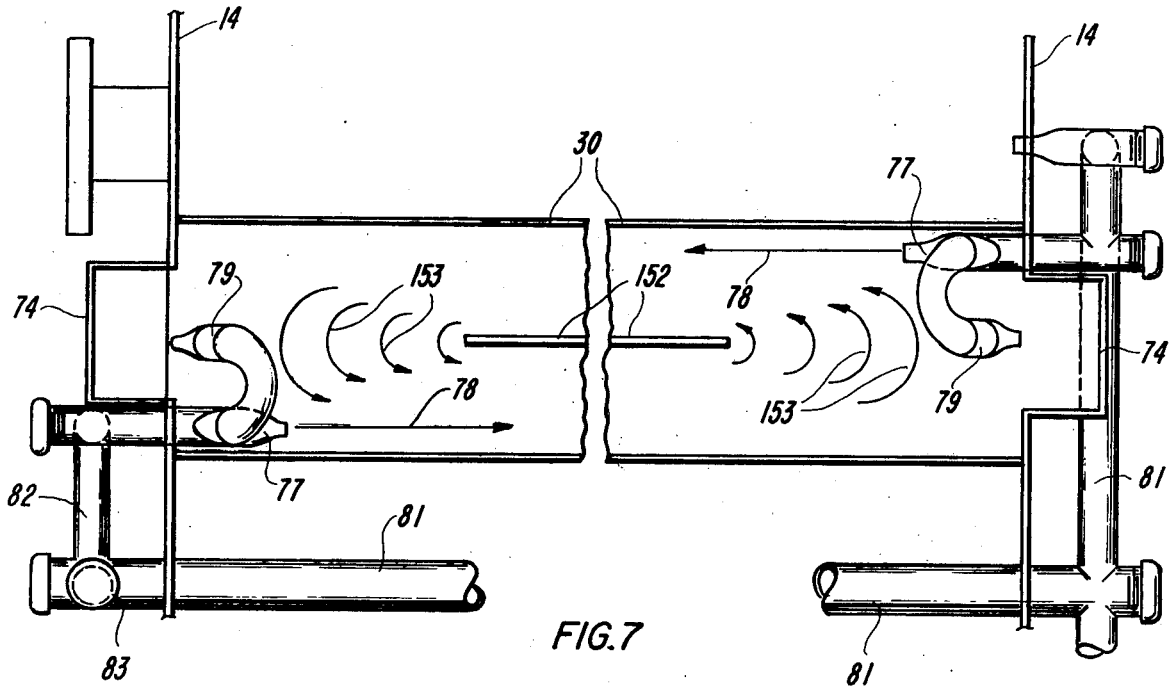
FIG. 7 is a fragmentary plan view taken along line 7—7 in FIG. 6.

FIGS. 6 and 7 illustrate an arrangement of nozzles for causing the labels collecting in the trough 30 to continually migrate through the transfer ducts 74 into the bottom of the compartment 24. In the plan view of FIG. 7 a pair of nozzles 77 are located at the opposite ends of trough 30 and are in opposed and offset positions so that fluid circulation from the nozzles will tend to establish a current indicated by the arrow 78. The nozzles 77 are combined with cooperating nozzles 79 which are directed to point into the inlet opening 75 of the transfer ducts 74 so that there is a "venturi" effect produced to encourage and accelerate the movement or migration of the labels by creating currents of fluid movement in the transfer ducts 74. The respective nozzles 77 and 79 at the right hand side of FIG. 7 are connected to a supply pipe 80 which is fed by a cross supply pipe 81 running to the left side of the compartment to a supply connection 82 for the respective nozzles 77 and 79. Fluid for the nozzles on both ends of the trough 30 is delivered through the main pipe 83 from a source to be described presently in FIG. 8. In addition to the nozzles above described, the collection of labels on the floor 27 of the compartment 24 are substantially encouraged to migrate toward the drain outlet 84 by secondary nozzles 85 entering the bottom of the compartment 24 through the wall 14 opposite to the location of the drain 84.

Figure 3:
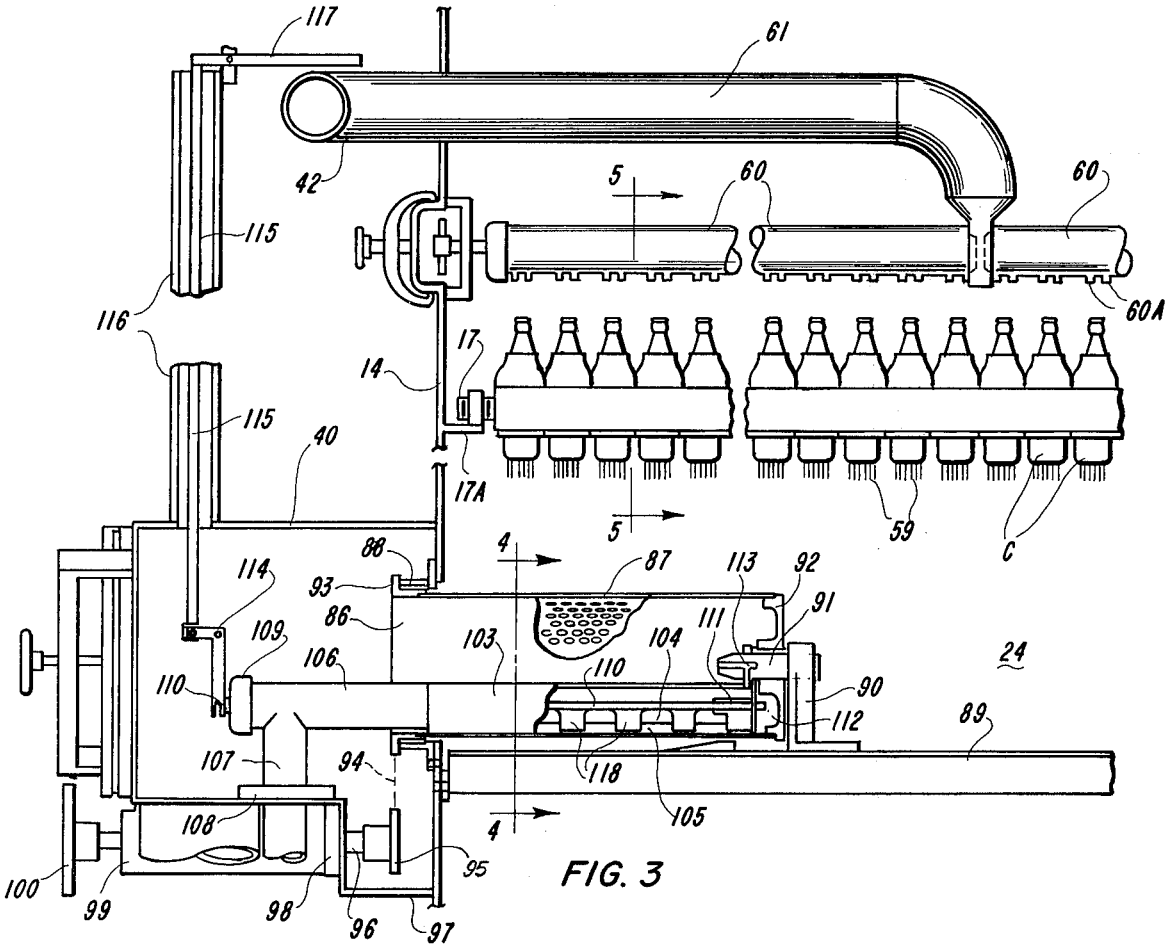
FIG. 3 is a fragmentary sectional view transverse of the washer taken along line 3—3 in FIG. 1.

Attention will now be directed to FIGS. 1, 3 and 4 for an understanding of the means at junction box 40 and 40A provided for supplying label free washing solution to the manifolds 60, 63 and 68 (FIG. 2). The view of FIG. 3 is a detail taken in FIG. 1 for the compartment 24. A similar assembly is shown for the compartment 28 at the junction box 40A so it will not be necessary to repeat the description. The junction box 40 is mounted over an opening in the side wall 14 to enclose the outer end 86 of a rotating screen 87. There is a suitable bearing 88 for the open end 86 of the screen 87 and the screen projects into the compartment 24 a suitable distance so as to expose its perforated surface to the washing solution which will be contaminated with labels being flushed off the containers C and out of the carrier pockets by the nozzles mounted in the manifold 60. There is a support beam 89 spanning the distance between the side walls 14, and this beam carries a bearing bracket 90 having a fixed shaft 91 extending into the bearing hub 92 which closes the inner end of the screen 87. The hub 92 rotates relative to the shaft 91, and the rotation is achieved by positioning a sprocket 93 on the open outer end of the screen 87 and connecting the sprocket by a drive chain 94 to a sprocket 95 carried on a shaft 96 which extends out over a bottom wall 97 in the junction box 40 through a seal 98 to be supported in a bearing housing 99. The shaft 96 is driven from a sprocket 100 which is connected by a chain 101 (FIG. 1) to the output sprocket of a motor 102 mounted on the side of the junction box 40. Since the screen 87 is opening at its outer end 86 the washing solution will flood the junction box 40, and this requires that the shaft 96 must be quarded by a suitable fluid seal 98.

The screen 87 is caused to rotate for the purpose of permitting the labels drawn and sucked on to the outer surface thereof to be flushed off so as not to unduly obstruct the cleaning or straining function of the screen. The interior of the screen 87 (FIGS. 3 and 4) is penetrated by a conduit 103 which has an open longitudinal side facing toward the interior of the screen, and the open side is closed by a pair of longitudinal blocks 104 which are spaced to form a longitudinal slot 105. The conduit 103 is connected near the open end 86 of the screen to a pipe 106 which has a fluid delivery pipe 107 extending through a suitable seal 108 in the junction box 40 to the exterior so as to connect with the pipe 41 previously described in connection with FIG. 1. The end of the pipe 106 located in the junction box 40 is formed with a cap 109 for the purpose of permitting an operating rod 110 to project through the cap, and rod 110 extends for the full length of the pipe 103 with its end slideably mounted in a guide 111 on the outer closure cap 112 for the pipe 103. The closure cap 112 is suitably supported on the stationary shaft 91 and is formed with a back flush passage 113 in the shaft 91 for the purpose of flushing out sediment that might accumulate in the area inside the closure cap 112. The end of the rod 110 which projects through the cap 109 in the junction box is connected to one arm of a bellcrank 114, and the other arm of the bellcrank is connected to an actuating rod 115 which extends vertically out of the junction box through a standpipe 116 to the outer end above the liquid level line where an actuating handle 117 is provided. It will be observed that the portion of the rod 110 located in the pipe 103 is formed with a series of spaced scrapers or blades 118 which project into the slot 105 between the spaced blocks 104. Periodical operation of the handle 117 will cause the scraper blades 118 to sweep back and forth in the slot 105 and dislodge any obstruction to the flow of fluid from the pump 37 and pipe 41, such flow being important to pass through the screen perforates and flush off labels. As the screen rotates the flushing action will suffice to keep the screen functionally active to deliver clean washing fluid into the junction box where it will flow by the outlet conduit 38 to the suction side of the pump 34.

The foregoing description has related to the rotary screen and provisions for flushing labels off of the screen in compartment 24. The identical organization of components is mounted in the compartment 28 where the screen flushing means is supplied with fluid from pipe 50 connected to the delivery pipe 49 from pump 44. In each screen flushing assembly there is a control valve at 43 and 51 which will be manually regulated for the desired flow of fluid so that the rotating screen will be kept desirably free of labels. The pump 34 is connected by conduit 38 to the junction box 40 for the purpose of establishing the suction flow of fluid through the screen 87, and the same arrangement is seen for compartment 28 where the suction conduit 48 for the pump 44 is connected to the junction box 40A.

Figure 8:
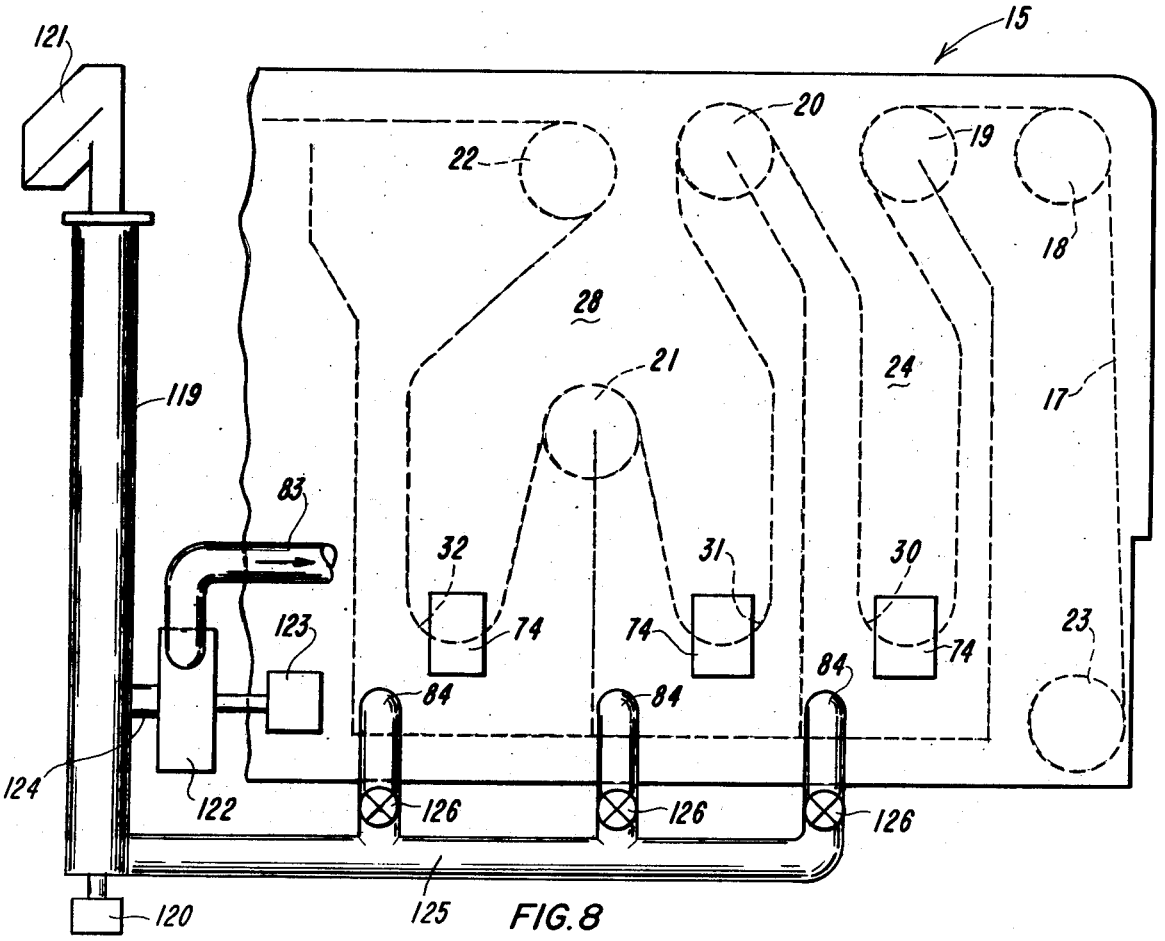
FIG. 8 is a general side elevational view of the apparatus opposite to FIG. 1, and more particularly seen along line 8—8 in FIG. 6.

Turning now to FIG. 8 it is seen that the side of the apparatus 16 opposite that shown in FIG. 1 is utilized for connecting the troughs 30, 72 and 73, as well as the bottom area of compartment 28 and 24 to a label separator 119. The separator is a generally vertically directed member having an interior helical screw, as disclosed in the before mentioned U.S. Pat. No. 3,162,204, driven by a motor 120 and delivering labels substantially free of fluid through the upper outlet chute 121. A centrifugal pump 122 driven by a motor 123, is connected by a suction conduit 124 to the side of the separator 119 and the pump delivers cleaned washing solution through the delivery pipe 83. This pipe is connected in the manner shown in FIG. 7 to the system of nozzles disposed in the trough 30, and to the nozzles in the bottom of the compartment 23 seen in FIG. 6, for the purpose of continually causing the labels falling into the trough 30 to migrate into the bottom of the compartment 24 through the transfer ducts 74. While not shown, the troughs 31 and 32 are provided with a similar arrangement of nozzles which function in a like manner to continually cause the labels collecting in the troughs 31 and 32 to migrate through the transfer ducts 74 into the bottom of the compartment 28. The action of the centrifugal pump 122 creates a suction flow in the drain collecting conduit 125, and this latter conduit is connected to the respective drain pipes 84 opening out of the bottom of the compartments. Control valves 126 are provided for the purpose of being able to apply the suction effect of the pump 122, in any desired order of selection, to any of the compartment bottom areas where the label collection is more profuse.

Figure 9:
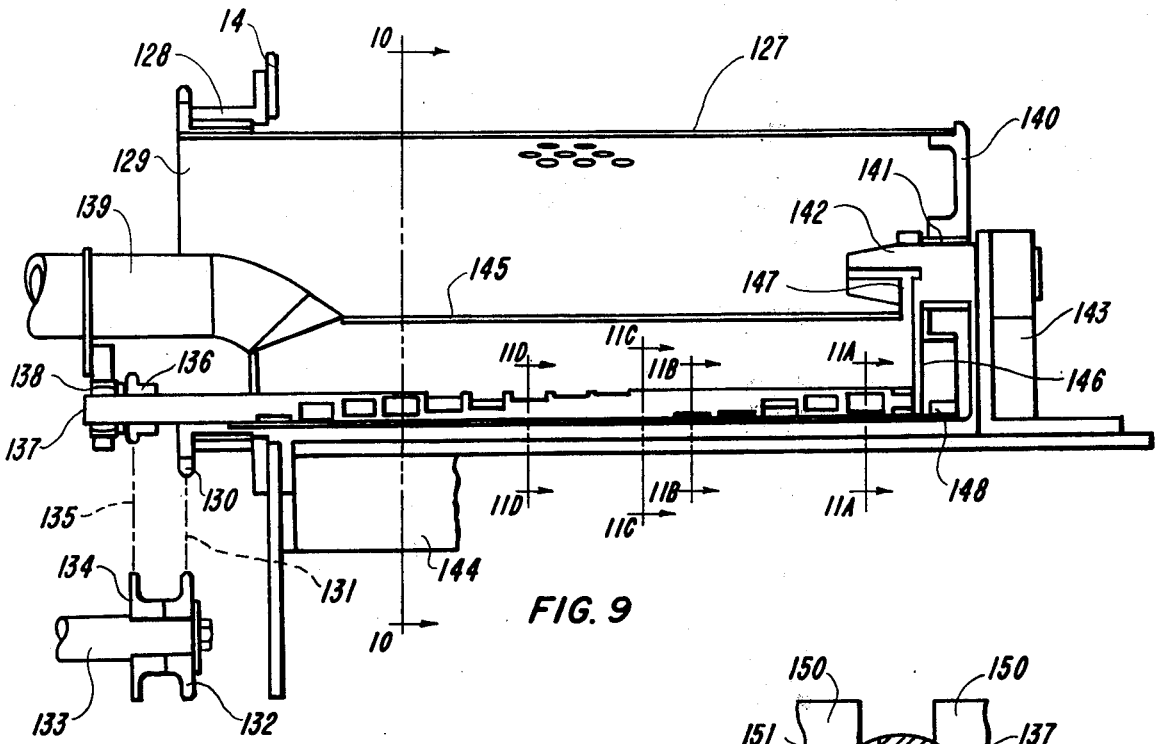
FIG. 9 is a modification of components shown in a view similar to the view of FIG. 3.
Figure 10:
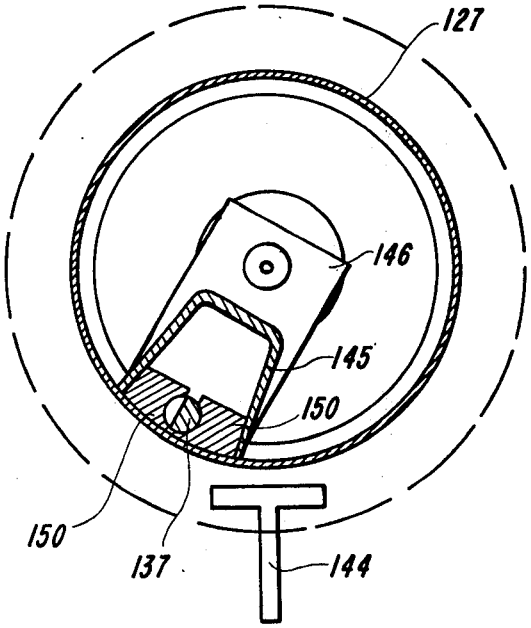
FIG. 10 is a section view taken at line 10—10 in FIG. 9.

In FIGS. 9 and 10 there is shown a modified arrangement of components for operating the rotary screen 127 which functions in substantially the same manner as the rotary screen 87 previously described in FIG. 3. In the modified arrangement, the rotary screen 127 is mounted in the wall of the tank 14 on a suitable bearing 128 adjacent the open end 129 which is surrounded by a sprocket 130. The sprocket is connected by a suitable chain 131 to a drive sprocket 132 mounted on shaft 133. This shaft is suitably connected to a drive motor in an arrangement similar to that seen in FIG. 3. The sprocket 132 has a secondary sprocket 134 mounted on the shaft 133 and the sprocket 134 is connected by a chain 135 to a sprocket 136 fastened on the end of a shaft 137. The adjacent end of the shaft 137 is carried in a suitably bearing 138 supported from the adjacent pipe 139. The opposite end of the rotary screen 127 projects into the compartment and is provided with a supporting hub 140 carried on a bearing 141, and the bearing 141 is supported on the spindle 142 of bracket 143, in turn, fastened to a suitable beam 144 extending across the width of the washer so as to be supported at its ends on the walls 14. It is also seen that the pipe 139 is connected to an open sided conduit 145 so as to deliver a fluid under pressure along the conduit and out to the closed end 146 where there is provided a back flush passage 147 in the spindle 142 so as to prevent accumulation of sediment in the outer end of the conduit 145. The end closure 146 is formed with a bearing socket 148 which receives the end of the shaft 137 so that the shaft is able to rotate between the socket 148 and the bearing 138.

Figure 11A:
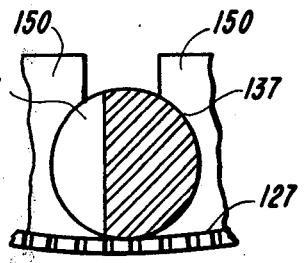
FIGS. 11, 11*a*, 11*b* and 11*c* are transverse section views taken at the four places indicated in FIG. 9 to illustrate the sequence of operation of the flow of fluid to flush labels collecting on the screen.
Figure 11B:
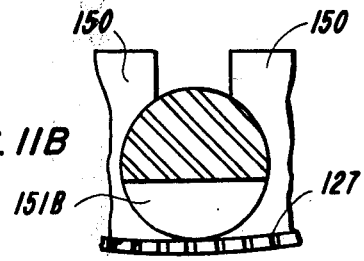
Figure 11C:
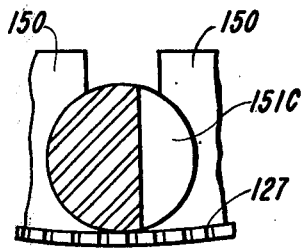
Figure 11D:
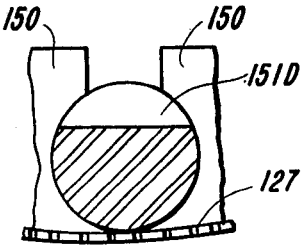

It can be seen in FIGS. 9, 10 and 11A through 11D inclusive that the shaft 137 is operatively mounted between a pair of blocks 150 seated in the open side of the conduit 145. The shaft 137 is formed with a series of slots which are spaced along the length of the shaft and are stepped around the circumference of the shaft at approximately 30° of angular spacing. For example FIG. 11A shows that the shaft 137 is provided with a slot 151 which opens a fluid flow passage from the interior of the conduit 145 to the perforated rotating screen 127 so as to permit fluid to be delivered from the inside of the screen for flushing labels off of the screen. The view of FIG. 11B depicts the position of the slot 151B turned away from the interior of the conduit 145 so that no fluid can be delivered to flush the screen 145. The view of FIG. 11C shows the slot 151C is displaced 180° from the slot 151 of FIG. 11A so that again fluid will be delivered to the inside of the screen to flush labels therefrom. The view of FIG. 11D shows the slot 151D in the shaft 137 positioned to cut off the flow of screen flushing fluid. It can be surmised from the foregoing description that rotation of the shaft 137 will periodically and sequentially cause the respective slots to register with the interior of conduit 145 so that fluid will be released through the respective slots for flushing labels off the screen 127 as the screen surface passes the location of the shaft 137. The speed of rotation of the screen and the shaft 137 is different.

Attention will again be directed to FIGS. 6 and 7 for the details of means to improve the control of the migration of labels collecting in the respective troughs 30, 31 and 32. The view in the drawing concernings the trough 30 and as indicated therein the mid portion of the trough 30 between the walls 14 is provided with a vertically directed divider plate 152 which is mounted to extend longitudinally and approximately in the center line of the trough. The plate 152 is so located that it will prevent the head on collison of the horizontal jetstreams generated from the nozzles 77, the jetstreams being indicated by the arrows 78. The plate 152 thereby forces the current of label flushing fluid to setup low velocity circulating currents shown by the arrows 153, and these currents circulate around the opposite ends of the plate 152. The plate 152 extends upwardly above the elevation of the nozzles 77 so as to prevent the streams 78 from being able to cross over the plate 152 and reduce the desired control of fluid movement within the trough 30. Without the divider plate 152, the nozzle streams 78 are able to fan out horizontally and impinge on each other with the result that the colliding streams would move vertically and tend to keep the labels in a constant vertical circulating path. This undesirable action is avoided by the divider plate 152 and an exceptionally efficient label removing result has been obtained by the divider plate and with the assistance of the auxiliary nozzles 79 pointed into the transfer ducts 74.

Figure 12:
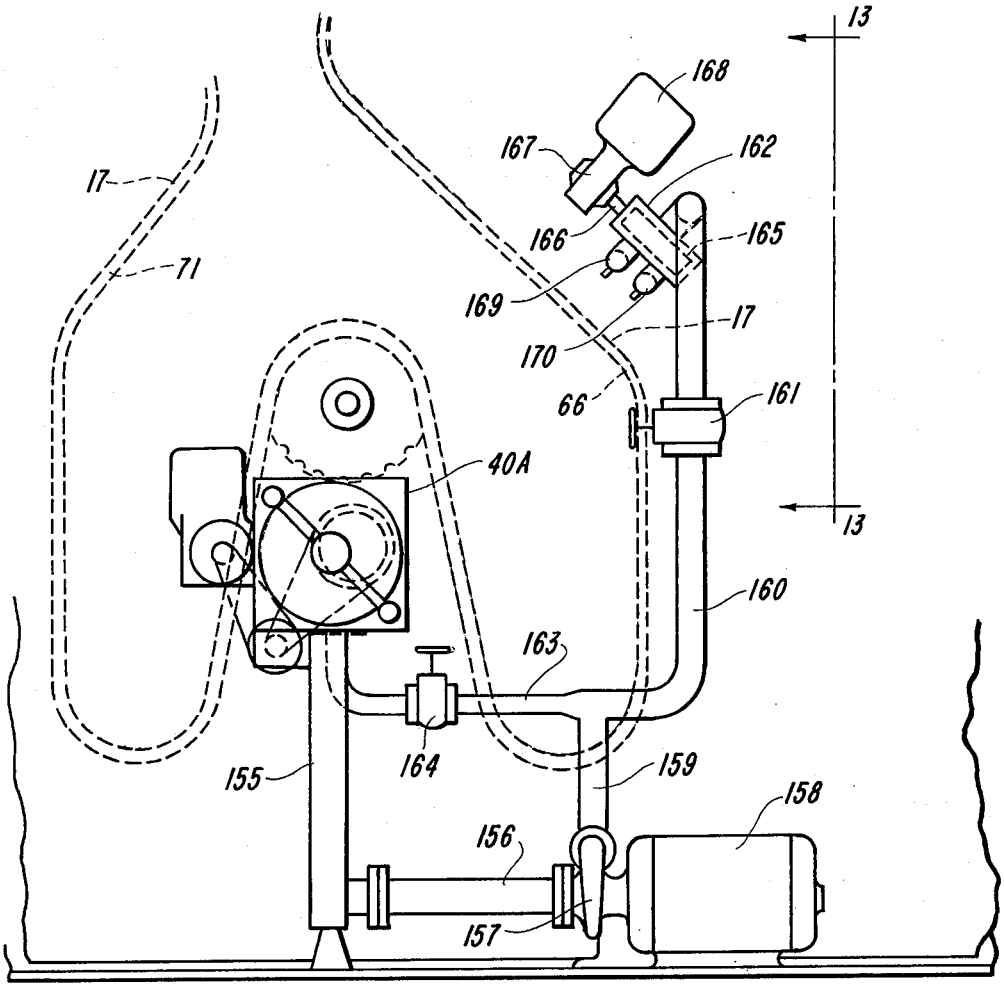
FIG. 12 is a fragmentary and diagrammatical side elevational view similar to FIG. 1 but showing a modified arrangement of the fluid flow system for supplying label flushing jets where the jets are located above the liquid level.
Figure 13:
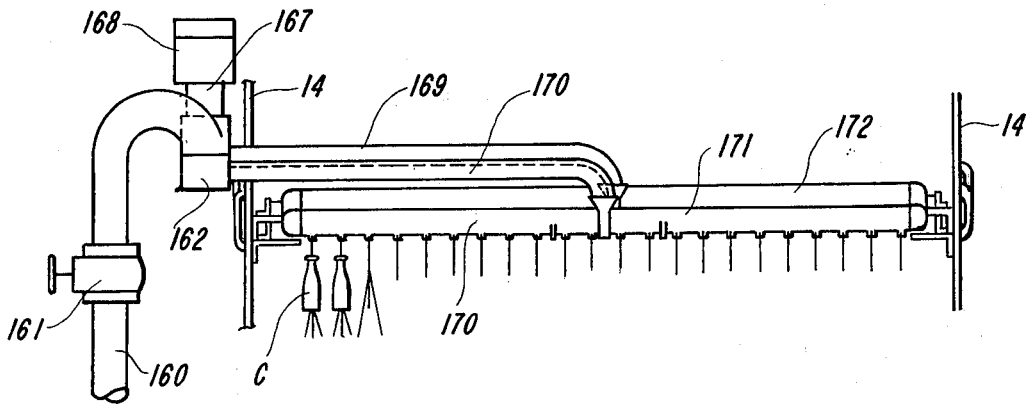
FIG. 13 is a fragmentary view of the system shown in FIG. 12 as seen along the line 13—13.

The foregoing description relating to the system for supplying clean fluid to the respective label flushing nozzles 60A as seen in FIG. 5 has been in regard to the position of these nozzles below the liquid level L as seen in FIG. 2. This location is important to avoid creating foam in the caustic solution, as foam would detract from the efficient flushing result desired. In certain instances where foam is not a problem, the flushing nozzles may be located above the liquid level, and some of the latter instances would be exemplified by intermittent jetting. Turning now to FIGS. 12 and 13 it can be seen that the junction box 40A is connected by a suction conduit 155 to the suction inlet 156 of the centrifugal pump 157 driven by a motor 158. The delivery side of the centfifugal pump is represented by the pipe 159 having a main branch 160 leading upwardly past a control valve 161 to a rotary valve 162. A secondary branch pipe 163 is connected through a control valve 164 into the junction box 40A for supplying fluid to flush labels off of the rotary screen associated with the junction box in the manner heretofor shown and described in connection with FIG. 3 or FIG. 9. The rotary valve 162 is formed with a rotating core 165 connected by shaft 166 into a gear box 167 which receives its power from motor 168. The rotating core 165 sequentially connects the fluid supply pipe 160 to the feed conduits 169 and 170 which extend through the wall 14 and are connected to a pair of flow dividing manifolds 171 associated with the feed conduit 170, while the feed conduit 169 is similarly connected to manifolds 172. The respective manifolds are provided with nozzles for delivering a jet of fluid over the containers C carried in the carriers 33 past the zone where the guide sheets 66 are interrupted by the spaced bars 65. The rotary valve 162 possesses the characteristics of the flow control valve heretofore disclosed in the application of Momir Babunovic et al, Ser. No. 547,236, filed Feb. 5, 1975, and assigned to the assignee of this application. In that prior application the rotary valve had more than 2 outlets subject to the sequential control of a rotor, while the present installation of the rotor is modified to establish sequential flow to the feed conduits 169 and 170, whereby the flushing jets are caused to be intermittent for the purpose of conserving energy by reducing the required output from the centrifugal pump 157, as compared to the requirements for the pumps disclosed in FIG. 1.

The foregoing description has set forth certain preferred arrangements of components in container washing apparatus, and these components are particularly directed to means for flushing labels off of containers carried in pockets, means for removing the collection of flushed off labels from the operating zone of the container carrying conveyors, and control of the circulation of fluid which desirably moves the labels out of the washer completely. It is of course understood that modifications may be made after the details of the foregoing disclosure has been understood, and it is the aim to include these modifications within the scope of the disclosure.

What is claimed is:

1. Container washing apparatus comprising a washing solution containing compartment, container carrier conveyor means operable to carry containers in a loop path which is directed downwardly and then upwardly through said compartment, imperforate guide means in said compartment in position to be engaged by the containers in the downward and upward travel, said guide means being interrupted at a zone above the bottom of the loop path where said carrier conveyor and the containers will transverse the interruption, nozzle means disposed adjacent to said interruption in said guide means to deliver a flow of fluid to pass over the containers and through said carrier conveyor for flushing labels therefrom, a pump outside of said compartment having an outlet connected to said nozzle means and an inlet connected into said compartment to receive washing solution from said compartment and circulate it through said nozzle means back to said compartment, filter means submerged in said compartment and located to cover said pump inlet connection into said compartment, said filter means operating to exclude labels from the washing solution drawn in by said pump and a branch connection from said pump outlet extending into said filter means to return filtered washing solution to said filter means to flush labels therefrom.

2. The apparatus of claim 1, wherein said filter means is a rotary screen projecting into said compartment from one wall thereof, and said branch connection from said pump outlet includes a conduit extending along inside said rotary acreen and positioned to deliver the returned washing solution through said screen.

3. The apparatus of claim 2 wherein said branch connection in said screen includes a conduit portion having an elongated slot opening toward the screen interior to direct the filtered washing solution through the screen, and means is operably mounted in said slot to clear obstructions and maintain said slot free to pass the washing solution.

4. The apparatus of claim 3, wherein said operable means in said elongated slot is a rotatable shaft formed with a series of flats which periodically open and close said elongated slot to the passage of the filtered washing solution.

5. The apparatus set forth in claim 1 wherein there is a junction box on said compartment opening to the interior, said filter means is a rotary screen having a closed end in said compartment and an open end at said junction box, said pump inlet is connected to said junction box to draw washing solution from said compartment, and said branch connection extends through said junction box into the open end of said screen to deliver filtered washing solution to the screen interior to flush labels therefrom.

6. The apparatus set forth in claim 1 wherein solution transfer means for the apparatus is disposed to place said guide loop in communication with the bottom of said compartment, fluid circulating means in said guide loop is operable to flush labels collecting in said guide loop into the bottom of said compartment, and a pump and label separator device has a delivery side connected to said fluid circulating means and a suction side connected into said compartment bottom, said separator device extracting labels from the solution.

7. The apparatus set forth in claim 6, wherein said solution transfer means consists in ducts opening from opposite ends of said guide loop into the bottom of said compartment, and said fluid circulating means includes nozzles in said guide loop to direct jets of washing solution therein for moving washing solution burdened with labels into said ducts.

8. The apparatus of claim 7 wherein said nozzles include a pair thereof at each duct, one nozzle of each pair being pointed longitudinally of said guide loop to agitate the labels in that direction, and the other nozzle of each pair being pointed toward an adjacent duct to draw label bearing washing solution out of said guide loop and into said ducts.

9. The apparatus of claim 6, wherein other fluid circulating means is connected to said delivery side and is positioned in the compartment bottom.

10. Container washing apparatus comprising: a washing solution containing compartment open at the top; a label collecting trough spaced above the bottom of said compartment; imperforate sheets extending upwardly in said compartment from said trough and being arranged in spaced relation to guide labels toward said trough; one of said sheets being interrupted below the top of said compartment to form an opening into the space between said sheets; container conveying means movable into and out of said compartment along the outside of said sheets and around the underside of said trough, said containers traversing said interruption in said one sheet; passage means opening from opposite ends of said trough into the bottom of said compartment below said trough; first label flushing nozzle means disposed adjacent said interruption to direct a stream of washing solution over the containers to carry the labels into the space between said sheets; second label flushing nozzle means in said trough in spaced and opposed relation; washing solution circulating means connected from an intake in the space between said sheets to said first and second label flushing nozzle means; and baffle means in said trough in position to separate the opposing streams from said second label flushing nozzle means, whereby the labels entrained by the circulating washing solution are prevented from colliding and move through said passage means to the bottom of said compartment.

11. The container washing apparatus set forth in claim 10, wherein said baffle means divides said trough into side by side spaces with its ends spaced from said second label flushing nozzle means, whereby washing solution burdened with labels may circulate around the ends and in opposite directions through the side-by-side spaces.

* * * * *